US005284593A

United States Patent [19]

Baevsky

[11] Patent Number: 5,284,593

[45] Date of Patent: Feb. 8, 1994

[54] NONCHELATING METAL FINISHING COMPOUNDS

[75] Inventor: Melvin M. Baevsky, Kalamazoo, Mich.

[73] Assignee: Roto-Finish Company, Inc., Kalamazoo, Mich.

[21] Appl. No.: 577,694

[22] Filed: Sep. 4, 1990

Related U.S. Application Data

[63] Continuation-in-part of Ser. No. 515,091, Apr. 26, 1990, abandoned.

[51] Int. Cl.[5] ..... C10M 173/02; C10M 105/56; C09K 13/00

[52] U.S. Cl. ..... 252/49.3; 252/50; 252/51.5 R; 252/79.1; 134/3; 134/41

[58] Field of Search ..... 252/51.5 R, 49.3, 50, 252/79.1; 134/3, 41; 72/42

[56] References Cited

U.S. PATENT DOCUMENTS

| | | | |
|---|---|---|---|
| 3,282,850 | 11/1966 | Davidowich et al. | 252/390 |
| 3,519,458 | 7/1970 | Rausch | 252/390 |
| 4,086,153 | 4/1978 | Ariga et al. | 204/181.4 |
| 4,120,654 | 10/1978 | Quinlan et al. | 252/390 |
| 4,235,051 | 11/1980 | Spekman, Jr. | 51/316 |
| 4,256,591 | 3/1981 | Yamamoto et al. | 352/51.5 R |
| 4,367,092 | 1/1983 | Unzens | 252/391 |
| 4,528,039 | 7/1985 | Rubin et al. | 252/135 |
| 4,532,065 | 7/1985 | Cohen et al. | 252/135 |
| 4,756,846 | 7/1988 | Matsuura | 252/174.21 |

*Primary Examiner*—Margaret Medley

*Attorney, Agent, or Firm*—Varnum, Riddering, Schmidt & Howlett

[57] ABSTRACT

A lubricating agent for a burnishing compound comprising an aqueous solvent, an alkyl betaine that is soluble in the aqueous solvent, and a nonchelating acid that is soluble in the aqueous solvent. The alkyl betaine is of the formula:

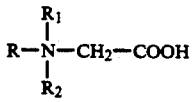

wherein R, $R_1$, $R_2$ are organic radicals that are the same or different. The nonchelating acid can be a monocarboxylic acid. A nonchelating tertiary amine can be formulated with the lubricating agent to resist the formatting corrosion.

75 Claims, No Drawings

NONCHELATING METAL FINISHING COMPOUNDS

This application is a continuation-in-part of application Ser. No. 515,091, filed Apr. 26, 1990, now abandoned.

BACKGROUND OF THE INVENTION

1. Field of the Invention

This invention relates generally to metal finishing compounds and, more particularly, to a nonchelating metal finishing compound that is adapted for use in a mass finishing apparatus.

2. Description of the Related Art

Finishing processes for the manufacture of metal parts or components are often carried out in two stages: deburring followed by burnishing. In the deburring stage, the metal parts are placed in a mass finishing apparatus such as a vibratory, barrel, or centrifugal finisher with an appropriate media that typically comprises substantially solid, irregularly shaped members that impinge the metal parts to remove rough corners and edges as well as manufacturing waste adhering to the parts.

In the burnishing stage, the metal components are retained in the vibratory, barrel or centrifugal finisher and are mixed with an appropriate burnishing compound. The burnishing compound generally comprises case hardened steel or stainless steel balls, cones, ball cones, eggs or other members of appropriate shape (media) and a lubricating agent that is continuously fed into and drained from the finisher. As the metal components vibrate and forcibly brush past the lubricated media, manufacturing oils and the like are removed and a bright, lustrous, polished appearance is imparted to the surface of the metal components. Different formulations for the burnishing compound are known, examples of which are disclosed in U.S. Pat. No. 4,235,051, issued Nov. 25, 1980 to Spekman, Jr. and assigned to Fremont Industries, Inc. and U.S. Pat. No. 4,367,092, issued Jan. 4, 1983 to Unzens and assigned to Roto-Finish Company, Inc.

Typically, the lubricating agent is maintained at an acidic pH to inhibit the formation of iron hydroxides, the iron resulting from the steel or stainless steel media. The acidic pH also inhibits the formation of other metal hydroxides, the particular hydroxide, of course, depending on the composition of the metal part being finished. The formation of metal hydroxides during burnishing is considered undesirable because it tends to cloud or obscure the lubricating agent, thereby detracting from its utility and shortening its effective life. Perhaps even more importantly, the metal hydroxides can be transferred to the surfaces of the metal parts being finished, thereby deteriorating the bright, polished, lustrous appearance that the burnishing stage is intended to impart to the finished metal components. To further inhibit the formation of metal hydroxides, chelating agents are often incorporated into the lubricating agent. Alternatively, a lubricant that is inherently chelating is employed or an acid having inherent chelating properties is used to acidify the lubricating agent. The chelating agents complex the iron or other heavy metal ions and form stable, soluble organo-metallic complexes that remain in solution without detracting from the burnishing process. Most commercially available barrel or vibratory burnishing agents presently known, including those identified in the above-referenced patents to Spekman, Jr. and Unzens, contain a high proportion of chelating agents.

However, increasingly stringent environmental regulations on the federal, state and municipal levels have made it more difficult if not illegal to dispose aqueous industrial waste having high concentrations of heavy metals into the public sewer system. The maximum allowable concentration of heavy metal salts in industrial waste streams is declining in response to enhanced environmental concerns. Copper salts, as one example, are particularly problematic because they are considered toxic even at relatively low concentrations. Normally, heavy metals can be removed from an industrial effluent stream by adjusting the pH of the stream to a range of approximately 8.5-9.5. Within this pH range, most heavy metals can be precipitated as highly insoluble hydroxides and thereafter filtered from the effluent, although a polymeric flocculating agent may be required to induce the formation of a coarse, readily filterable precipitate. However, the organo-metallic complexes that are formed in the presence of chelating agents are highly soluble and stable and do not readily form filterable precipitates under the industrial effluent treatment conditions presently utilized. As a result, the organo-metallic complexes or chelates pass unchanged through the effluent treatment and enter the public sewer system.

As noted hereinabove in the Background, it is desirable to maintain the lubricating agent at an acidic pH to inhibit the formation of metal, especially iron, hydroxides. However, there is a countervailing problem in that a low pH environment encourages the formation of corrosion. In a typical commercial burnishing operation, the mass finishing apparatus is drained of the lubricating agent at the end of each day as well as prior to longer periods of interruption, such as weekends and holidays. It is common for the case-hardened steel or stainless steel media to be retained in the mass finishing apparatus until it is needed for the next burnishing cycle. Exposure of the damp, lubricating agent coated media to the oxygen rich air provides an environment in which the rapid formation of corrosion on the media is promoted. The corrosion not only deteriorates and shortens the useful life of the burnishing media but can be imparted to the metal parts finished therewith, thereby further detracting from the bright, polished and lustrous appearance with which the metal parts are to be provided. Accordingly, lubricating agents are sometimes formulated with corrosion inhibitors. However, the most widely known corrosion inhibitors are also excellent chelating compounds. For example, the corrosion inhibiting compounds disclosed in the above-identified patent to Unzens are chelating agents. As described hereinabove, it is undesirable for the burnishing agent to include a chelating compound as such will complex the heavy metal ions resulting from the steel media or the parts being finished therewith.

Thus, there is a considerable need for a burnishing agent that imparts a bright, polished, lustrous appearance to the metal components being treated but which is free from compounds that tend to chelate or complex the metal ions that result from the steel media or the metal of the parts being finished. With such a burnishing agent, heavy metals resulting from the media and the parts being finished can be easily precipitated and filtered from the industrial waste effluent as insoluble hydroxides by adjusting the pH of the waste stream.

There is also considerable need for a burnishing agent that incorporates a nonchelating corrosion inhibitor. Such a burnishing agent would be particularly useful because it would resist the formation of corrosion on the burnishing media when the media is exposed to the acidic lubricating agents that are commonly employed.

SUMMARY OF THE INVENTION

The invention relates to a lubricating agent for use in a burnishing compound. The lubricating agent comprises an aqueous solvent, an alkyl betaine that is soluble in the aqueous solvent, and a nonchelating acid that is soluble in the aqueous solvent. The alkyl betaine is of the formula:

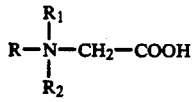

wherein R, $R_1$ and $R_2$ are organic radicals. Preferably R is an organic radical comprising from about 12 to about 20 carbon atoms, $R_1$ is in organic radical comprising from 1 to about 3 carbon atoms, and $R_2$ is an organic radical comprising from 1 to about 3 carbon atoms, although, R, $R_1$ and $R_2$ may be the same or different.

The lubricating agent should preferably comprise at least approximately 2% alkyl betaine by weight; 10–17% alkyl betaine by weight is particularly useful.

Preferably, the nonchelating acid is a monocarboxylic acid that includes an organic radical having from 1 to about 3 carbon atoms.

A nonchelating corrosion inhibitor can be added to the composition to prevent corrosion of the burnishing media. The corrosion inhibitor preferably has the formula:

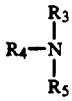

wherein $R_3$, $R_4$ and $R_5$ are organic radicals. The preferred inhibitor is one where $R_3$ is an organic radical comprising from about 8 to about 20 carbon atoms, $R_4$ is an organic radical comprising from about 8 to about 20 carbon atoms, and $R_5$ is an organic radical comprising from 1 to about 3 carbon atoms.

The lubricating agents are nonchelating in the sense that they do not form organo-metallic complexes with the metal ions of the burnishing media or with the metal ions of the manufactured parts that are being finished. As a result, the heavy metals can be treated with caustic in a conventional wastewater treatment process to form a gelatinous, insoluble mass of the metal salts. A polymeric flocculating agent is typically added to induce the formation of a coarse, grainy, readily filterable precipitate. Wastewater samples resulting from a burnishing operation in which a lubricating agent according to the invention was employed and subsequently treated as described above were found to have dissolved heavy metal concentration of 0.4 ppm or less.

The invention also relates to a method for burnishing manufactured parts. The method comprises the steps of placing the manufactured parts in a mass finishing apparatus such as a barrel, vibratory or centrifugal finisher, adding a burnishing media of suitable size, shape and composition to the parts, providing to the finisher at an appropriate rate a supply of a composition for lubricating the media, and rotating the finisher for a time sufficient to impart a bright, polished and lustrous appearance to the parts. Preferably, the lubricating composition comprises an alkyl betaine having the formula described above. The composition can also include a water soluble monocarboxylic acid as well as a nonchelating corrosion inhibitor.

DETAILED DESCRIPTION OF THE PREFERRED EMBODIMENTS

In the following description, it will be understood that the terms "burnishing agent" and "burnishing compound" encompass a media in combination with an agent for lubricating the media. The media can be selected from any of the types presently known and commercially utilized although media formed from either case hardened steel or stainless steel is particularly useful in conjunction with the novel lubricating agent according to the invention, as explained more fully hereinbelow. As noted hereinabove in the Background, case hardened steel and stainless steel media contribute to the formation of iron hydroxides during a metal finishing operation by providing an abundant source of iron ions. As well, metal hydroxides other than iron hydroxides can result from the metal parts being finished. Metal hydroxides of whatever type are undesirable. They cloud and obscure the burnishing agent, reduce the effectiveness and the life of the burnishing agent, and may be transferred or imparted to the metal components being finished. If the hydroxides contaminate the surfaces of the metal parts being finished, the lustrous, polished appearance of the parts deteriorates. The shape and size of the media utilized will be determined by the nature of the metal parts being finished. The novel lubricating agent according to the invention may be used in conjunction with media having any shape including but not limited to balls, cones, ball cones, eggs and the like.

It has been found that a lubricating agent formulated from an aqueous solvent and an alkyl betaine provides a highly effective, nonchelating media lubricant that imparts excellent polish, brightness and lustre to metal components finished therewith. Alkyl betaine having the general structure illustrated below

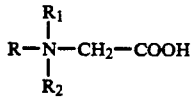

wherein the R-group is preferably a long chain alkyl substituent in the approximate range of about 12 to about 20 carbon atoms, and the $R_1$- and $R_2$- groups are shorter chain alkyl substituents preferably in the approximate range of 1 to about 3 carbon atoms, such as methyl, ethyl, propyl or isopropyl. Coco dimethyl betaine, stearyl dimethyl betaine, palmitic dimethyl betaine, oleyl dimethyl betaine, and tallow dimethyl betaine have been found particularly useful.

R-, $R_1$-, and $R_2$- groups having carbon chain lengths outside the preferred range can also be used. It has been found that the lubricity of the resulting formulation is enhanced as the carbon chain lengths increase although there is a parallel decline in the formulation solubility in an aqueous media. Thus, the particular R-, $R_1$- and $R_2$-groups should be selected to optimize both the solubility of the alkyl betaine in an aqueous media and the lubricity of the resulting formulation. The resulting formulation should have sufficient lubricity if the sum of the number of carbon atoms in the R-, $R_1$-, and $R_2$-groups of the alkyl betaine is within the range of about 14 to about 24. The lustre and brightness of the finished article increases as the alkyl betaine concentration is increased; however, economic considerations may limit the alkyl betaine concentration to a range of approximately 10% to 17% by weight. The specific concentration of the alkyl betaine will depend on the particular betaine utilized as well as the overall formulation of the burnishing compound, as explained more fully hereinbelow. Preferably, the lubricating agent should include at least 2% to 2.5% alkyl betaine by weight.

It has also been found desirable, in some situations, to acidify the lubricating agent so as to inhibit the formation of metal, especially iron, hydroxides. It has been found that an alkyl monocarboxylic acid having the general structure of

R—COOH wherein R is preferably hydrogen or an alkyl group having a carbon chain length in the approximate range of 1 to about 3 carbon atoms, such as formic acid, acetic acid, propionic acid or butyric acid, is particularly useful. The R-group may also be substituted by an alkyl group having a carbon chain length in excess of three carbon atoms so long as the resulting acid is soluble in an aqueous media.

EXAMPLE 1

A lubricating solution was prepared by combining the following ingredients in the concentrations, by weight, shown below.

| | |
|---|---|
| Coco dimethyl betaine (45% concentration) | 10.0% Wt. |
| Non-ionic surfactant | 2.5% Wt. |
| Glacial acetic acid | 6.0% Wt. |
| Water | 81.5% Wt. |

The pH of the resulting solution was 3.3; at 1% concentration, the pH was 5.4. Although glacial acetic acid is indicated, it is of course possible to use less than 100% acetic acid by a corresponding adjustment in the concentration by weight of acid that is added.

The solution was tested under commercial burnishing conditions at a concentration of 1 ounce of solution per gallon of water in a Roto-Finish Model ER0405 vibratory burnisher using commercial case hardened 3/16" ball cone steel media with copper and brass parts. The solution was fed to the burnishing machine at ambient temperature and at a rate of approximately 1 gal./hr./cu.ft. of machine capacity. The parts to media ratio was approximately 1:10 (approximately 150 pounds of parts to 1500 pounds of media).

Effluent samples were taken directly from the machine drain after 1 and 2 hours of processing and analyzed for copper concentrations using a Hach DR-3 Laboratory Spectrophotometer and the Hach Bichinchonate method (Hach Water Analysis Handbook). Both free and total dissolved copper concentrations were obtained. Both effluent samples showed a copper concentration of approximately 3 to 5 parts per million (ppm). After a typical wastewater treatment process, which consisted of adjusting the effluent sample pH to approximately 9.5 with a 5% solution of caustic (NaOH), addition of 1% of a commercially available anionic flocculent (0.25% wt.), and filtration to remove the resulting insoluble hydroxide precipitate, the total dissolved copper concentrations were 0.4 and 0.35 ppm, respectively. Coco dimethyl betaine having a 45% concentration is commercially available from Henkel Corp., Ambler, Pa. under the name Velvetex AB 45. A suitable example of an anionic flocculent is I Floc 355 commercially available from Ivanhoe Chemical Co., Mundelein, Ill.

EXAMPLE 2

A second lubricating solution was prepared by combining the following ingredients in the concentrations, by weight, shown below:

| | |
|---|---|
| Stearyl dimethyl betaine (40% concentration) | 10.0% Wt. |
| Non-ionic surfactant | 6.0% Wt. |
| Glacial acetic acid | 6.0% Wt. |
| Water | 78.0% Wt. |

The pH of the resulting solution was 3.1 and the pH at a 1% concentration was 5.1.

A 1% solution of the above formulation and containing 100 ppm copper was prepared by mixing 1 gram of the lubricating solution, 10 grams of a standard copper solution containing 1000±10 ppm copper as copper sulfate (available from Hach Co.), and 89 grams of water. After a standard wastewater treatment and filtration process as described in Example 1, the total dissolved copper was found to be 0.21 ppm.

When the second lubricating solution was used in a standard burnishing operation in a commercial Roto-Finish vibratory burnisher (as described in Example 1) with copper, brass and steel parts, the finished articles were of excellent luster, a bright color and were judged to be at least equal to or better than that generally obtained under similar conditions using commercially available burnishing compounds presently known. 40% stearyl dimethyl betaine is commercially available from Sherex Chemical Co., Dublin, Ohio under the name Varion SDG. The non-ionic surfactant can be the same as utilized in Example 1.

EXAMPLE 3

A third lubricating solution was prepared by combining the following ingredients in the concentrations, by weight, shown below:

| | |
|---|---|
| Oleyl dimethyl betaine (30% concentration) | 12.0% Wt. |
| Non-ionic surfactant | 2.0% Wt. |
| Glacial acetic acid | 4.2% Wt. |
| Water | 81.8% Wt. |

In tests such as that of Example 2, the total dissolved copper concentration after typical wastewater treatment was 0.12 ppm. 30% oleyl dimethyl betaine is commercially available from McEntyre Chemical Co., Ltd. Chicago, Ill. under the name Mackam OB-30.

EXAMPLE 4

A fourth lubricating solution was prepared by combining the following ingredients in the concentrations, by weight, shown below:

| | |
|---|---|
| Coco dimethyl betaine (45% concentration) | 12.0% Wt. |
| Non-ionic surfactant | 2.0% Wt. |
| Surfynol 104H | 1.0% Wt. |
| Glacial acetic acid | 4.0% Wt. |
| Water | 81.0% Wt. |

In tests such as that of Example 2, the total dissolved copper concentration after typical wastewater treatment was 0.28 ppm. Surfynol 104H is a nonchelating defoamer and wetting agent commercially available from Air Products Co. and is generally a 75% solution of tetraethyl decynediol in ethylene glycol.

EXAMPLE 5

A fifth lubricating solution was prepared by combining the following ingredients in the concentrations, by weight, shown below:

| | |
|---|---|
| Palmitic dimethyl betaine (22.5% concentration) | 17.0% Wt. |
| Non-ionic surfactant | 2.0% Wt. |
| Glacial acetic acid | 3.8% Wt. |
| Water | 77.2% Wt. |

In tests such as that of Example 2, the total dissolved copper concentration after typical wastewater treatment was 0.14 ppm. 22.5% palmitic dimethyl betaine is commercially available from DeForest, Inc., Richardson, Tex. under the name Detaine PB.

It will be apparent from the above examples that the resulting lubricating solutions have an acidic pH. Furthermore, as noted hereinabove in the Background, an acidic environment promotes the formation of corrosion. Corrosion forms on the lubricating solution dampened surfaces of the case-hardened steel media as the iron constituent thereof is exposed to the oxygen-rich air. Formation of corrosion on the media is considered undesirable because it not only deteriorates the media and shortens media life but can also be imparted to the metal components that are being finished therewith, thereby detracting from the bright, polished and lustrous appearance that the burnishing operation is intended to provide. Those corrosion inhibitors which are presently known also have excellent chelating properties, thereby making them unsuitable for use in conjunction with a lubricating agent according to the invention.

It has been found that a tertiary amine having the general structure

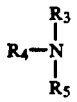

when formulated with the lubricating solutions described above provides a highly effective, nonchelating media lubricant that imparts excellent polish, brightness and luster to the metal components finished therewith and which resists the formation of corrosion on the media. Preferably the $R_3$ and the $R_4$ groups are long-chain alkyl substituents in the approximate range of about 8 to about 20 carbon atoms, and the $R_5$ group is a shorter chain alkyl substituent, preferably in the approximate range of about 1 to about 3 carbon atoms. Dicoco methylamine has been found particularly useful as a corrosion inhibitor. $R_3$, $R_4$, and $R_5$ groups having carbon chain lengths outside the preferred ranges can also be used.

The particular $R_3$, $R_4$ and $R_5$ groups should be selected to optimize both the solubility of the tertiary amine in an aqueous media and to minimize the tendency for the amine to function as a chelating agent. Amines are generally recognized as having chelating properties. The tendency for the amine to function as an effective chelator can be minimized by increasing the carbon chain lengths of the $R_3$, $R_4$ and $R_5$ organic radical alkyl substituents, thereby stearically hindering the central nitrogen atom and reducing the ability of the amine to function as a chelating group. As the carbon chain lengths increase, there is a parallel decline in the formulation solubility in an aqueous media.

The corrosion inhibitor is present in the lubricating solution in an effective amount, i.e., that which will reduce corrosion. This amount will depend on the particular corrosion inhibitor used but will generally be in the range of 0.5 to 5% by weight, preferably 1 to 3% by weight.

EXAMPLE 6

A sixth lubricating solution was prepared by combining the following ingredients in the concentrations, by weight, shown below:

| | |
|---|---|
| Stearyl dimethyl betaine (40% concentration) | 8.0% Wt. |
| Non-ionic surfactant | 6.0% Wt. |
| Isopropyl alcohol | 4.0% Wt. |
| Dicoco methylamine | 2.0% Wt. |
| Glacial acetic acid | 3.5% Wt. |
| Water | 76.5% Wt. |

The pH of the resulting solution was 3.4 and the pH of a 1% concentration was 5.0. In tests such as those of Example 2, the total dissolved copper concentration after typical waste water treatment, was 0.4 ppm. Dicoco methylamine is commercially available from Akzo Chemicals, Inc., Chicago, Ill., under the name Armeen M2C. As compared to the lubricating solutions described in Examples 1 to 5 hereinabove, the lubricating solution of Example 6 further includes 2.0% by weight dicoco methylamine as a corrosion inhibitor. The pair of long-chain coco groups sufficiently stearically hinder the central nitrogen atom so as to frustrate the performance of the amine as a chelating agent. The dicoco methylamine remains relatively soluble in an aqueous media although slight resistance to dissolution may be overcome by formulating the lubricating solution with small amounts of short chain alcohols such as isopropyl alcohol.

Each of the lubricating solutions described hereinabove comprises generally an alkyl betaine diluted with water to an effective concentration, the alkyl betaine preferably being substituted by one alkyl group having a carbon chain length in the range of about 12 to about 20 carbon atoms and also being substituted by two shorter carbon chain alkyl groups each having a carbon chain length of approximately 1 to about 3 carbon atoms. The resulting solution may be acidified with acetic acid or other water soluble monocarboxylic acid if desired, the acidic pH further inhibiting the formation of metal, especially iron, hydroxides. Each of the lubricating solutions is nonchelating in the sense that it does not form organo-metallic complexes with the metal ions of the media or the parts being finished. As a result, the heavy metals can be treated with caustic in a conventional wastewater treatment process to form coarse, insoluble, readily filterable metal salts. The thus treated wastewater samples were found to have a dissolved heavy metal concentration of 0.4 ppm or less in all cases.

The lubricating solutions may be additionally blended with surfactants, defoamers, nonchelating alcohols or the like as the situation demands although the presence of these compounds is not necessary for successful practice of the invention. For example, a nonionic surfactant may enhance the cleaning ability of the lubricating agent and its propensity for removing manufacturing oils and the like. Surfactants are widely available commercially and may include a variety of alcohols or petroleum derivatives.

The lubricating solutions may also be blended with a tertiary amine, preferably substituted by two organic radical alkyl groups having a carbon chain length in the range of about 8 to about 20 carbon atoms and also being substituted by a shorter chain organic radical alkyl group having a carbon chain length in the range of about 1 to about 3 carbon atoms. The alkyl groups of the tertiary amine are selected so as to maximize the solubility of the amine in an aqueous media and to reduce the tendency of the amine to function as a chelating group. The tertiary amine functions as a nonchelating corrosion inhibitor to resist the formation of corrosion on the media.

Reasonable variations or modifications are possible within the spirit of the foregoing specification and drawings without departing from the scope of the invention which is defined in the accompanying claims.

The embodiments for which an exclusive property or privilege is claimed are defined as follows:

1. A lubricating agent for a burnishing component comprising an aqueous solvent, an effective amount of an alkyl betaine that is soluble in the aqueous solvent, and a nonchelating acid that is soluble in the aqueous solvent wherein the alkyl betaine is of the formula:

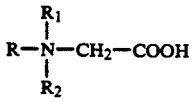

wherein R, $R_1$ and $R_2$ are organic radicals that are the same or different, said lubricating agent being free of effective amounts of chelating agents.

2. A lubricating agent according to claim 1 wherein the sum of the number of carbon atoms in the R, $R_1$ and $R_2$ organic radicals is in the range of about 14 to about 24.

3. A lubricating agent according to claim 2 wherein R is an organic radical comprising from about 12 to about 20 carbon atoms.

4. A lubricating agent according to claim 3 wherein $R_1$ is an organic radical comprising from 1 to about 3 carbon atoms.

5. A lubricating agent according to claim 4 wherein $R_2$ is an organic radical comprising from 1 to about 3 carbon atoms.

6. A lubricating agent according to claim 5 comprising at least approximately 2% alkyl betaine by weight.

7. A lubricating agent according to claim 6 comprising approximately 10–17% alkyl betaine by weight.

8. A lubricating agent according to claim 1 wherein the acid is a monocarboxylic acid.

9. A lubricating agent according to claim 8 wherein the acid includes an organic radical having from 1 to about 3 carbon atoms.

10. A lubricating agent according to claim 8 wherein R is an organic radical comprising from about 12 to about 20 carbon atoms.

11. A lubricating agent according to claim 10 wherein $R_1$ is an organic radical comprising from 1 to about 3 carbon atoms.

12. A lubricating agent according to claim 11 wherein $R_2$ is an organic radical comprising from 1 to about 3 carbon atoms.

13. A lubricating agent according to claim 12 comprising at least approximately 2% alkyl betaine by weight.

14. A lubricating agent according to claim 13 comprising approximately 10–17% alkyl betaine by weight.

15. A lubricating agent according to claim 14 wherein the acid comprises an organic radical having from 1 to about 3 carbon atoms.

16. A lubricating agent according to claim 1 further comprising an effective amount of a nonchelating corrosion inhibitor.

17. A lubricating composition according to claim 16 wherein the nonchelating corrosion inhibitor comprises a tertiary amine having the following formula:

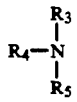

wherein $R_3$, $R_4$ and $R_5$ are organic radicals that are the same or different.

18. A lubricating agent according to claim 17 wherein $R_3$ is an organic radical comprising from about 8 to about 20 carbon atoms.

19. A lubricating agent according to claim 18 wherein $R_4$ is an organic radical comprising from about 8 to about 20 carbon atoms.

20. A lubricating agent according to claim 19 wherein $R_5$ is an organic radical comprising from 1 to about 3 carbon atoms.

21. A lubricating agent according to claim 16 wherein the nonchelating corrosion inhibitor comprises approximately 1–3% dicoco methylamine by weight.

22. A burnishing composition for finishing manufactured articles and providing the articles with a polished appearance comprising a lubricating agent according to claim 1 and a burnishing media of suitable size, shape and composition.

23. A burnishing composition according to claim 22 further comprising an aqueous diluent.

24. A burnishing composition according to claim 23 wherein the sum of the number of carbon atoms in the R, $R_1$ and $R_2$ organic radicals is in the range of about 14 to about 24.

25. A burnishing composition according to claim 24 wherein R is an organic radical comprising from about 12 to about 20 carbon atoms.

26. A burnishing composition according to claim 25 where $R_1$ is an organic radical comprising from 1 to about 3 carbon atoms.

27. A burnishing composition according to claim 26 where $R_2$ is an organic radical comprising from 1 to about 3 carbon atoms.

28. A burnishing composition according to claim 27 comprising at least approximately 2% alkyl betaine by weight of lubricating agent.

29. A burnishing composition according to claim 28 comprising approximately 10–17% alkyl betaine by weight of lubricating agent.

30. A burnishing composition according to claim 28 wherein the acid is a monocarboxylic acid.

31. A burnishing composition according to claim 23 and further comprising a nonchelating corrosion inhibitor.

32. A burnishing composition according to claim 31 wherein the nonchelating corrosion inhibitor comprises a tertiary amine having the following formula:

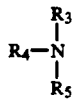

wherein $R_3$, $R_4$ and $R_5$ are organic radicals that are the same or different.

33. A burnishing composition according to claim 32 wherein $R_3$ is an organic radical comprising from about 8 to about 20 carbon atoms.

34. A burnishing composition according to claim 33 wherein $R_4$ is an organic radical comprising from about 8 to about 20 carbon atoms.

35. A burnishing composition according to claim 34 wherein $R_5$ is an organic radical comprising from 1 to about 3 carbon atoms.

36. A burnishing composition according to claim 31 wherein the nonchelating corrosion inhibitor comprises approximately 1–3% dicoco methylamine by weight.

37. A composition for lubricating media utilized in a burnishing operation comprising a sufficient amount of a nonchelating acid to inhibit the formation of metal hydroxides and a sufficient amount of an alkyl betaine to lubricate the media and to increase the lustre and brightness of articles burnished therewith, said composition being free of effective amounts of chelating agents.

38. A compound according to claim 37 wherein the alkyl betaine is of the formula:

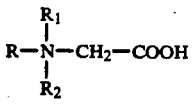

wherein R is an organic radical comprising from about 12 to about 20 carbon atoms and $R_1$ and $R_2$ are organic radicals that are the same or different.

39. A compound according to claim 38 wherein $R_1$ is an organic radical comprising from 1 to about 3 carbon atoms.

40. A compound according to claim 39 wherein $R_2$ is an organic radical comprising from 1 to about 3 carbon atoms.

41. A compound according to claim 40 comprising at least approximately 2% alkyl betaine by weight.

42. A compound according to claim 41 comprising approximately 10–17% alkyl betaine by weight.

43. A compound according to claim 37 wherein the acid is a monocarboxylic acid.

44. A compound according to claim 43 wherein the acid comprises an organic radical having from 1 to about 3 carbon atoms.

45. A compound according to claim 38 further comprising a nonchelating corrosion inhibitor.

46. A compound according to claim 45 wherein the nonchelating corrosion inhibitor comprises a tertiary amine having the following formula:

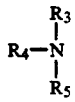

wherein $R_3$, $R_4$ and $R_5$ are organic radicals that are the same or different.

47. A compound according to claim 46 wherein $R_3$ is a organic radical comprising from about 8 to about 20 carbon atoms.

48. A compound according to claim 47 wherein $R_4$ is an organic radical comprising from about 8 to about 20 carbon atoms.

49. A compound according to claim 48 wherein $R_5$ is an organic radical comprising from 1 to about 3 carbon atoms.

50. A compound according to claim 45 wherein the nonchelating corrosion inhibitor comprises approximately 1–3% dicoco methylamine by weight.

51. A method for burnishing manufactured parts comprising the steps of:

placing the manufactured parts in a burnishing zone in a mass finishing apparatus;

adding a burnishing media of suitable size, shape and composition to the burnishing zone;

providing to the burnishing zone at an appropriate rate a supply of a composition for lubricating the media; and rotating the burnishing zone for a time sufficient to impart a bright, polished and lustrous appearance to the parts;

wherein the lubricating composition is free of effective amounts of chelating agents and comprises an effective amount of an alkyl betaine having the formula:

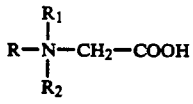

wherein R, $R_1$ and $R_2$ are organic radicals that are the same or different.

52. A method according to claim 51 wherein the sum of the number of carbon atoms in the R, $R_1$ and $R_2$ organic radicals is in the range of about 14 to about 24.

53. A method according to claim 52 wherein R is an organic radical comprising from about 12 to about 20 carbon atoms.

54. A method according to claim 53 wherein $R_1$ is an organic radical comprising from 1 to about 3 carbon atoms.

55. A method according to claim 54 wherein $R_2$ is an organic radical comprising from 1 to about 3 atoms.

56. A method according to claim 55 wherein the lubricating composition comprises at least approximately 2% alkyl betaine by weight.

57. A method according to claim 56 wherein the lubricating composition comprises approximately 10–17% alkyl betaine by weight.

58. A method according to claim 51 wherein the lubricating composition further comprises a nonchelating acid.

59. A method according to claim 58 wherein the nonchelating acid is provided in an amount sufficient to inhibit the formation of metal hydroxides.

60. A method according to claim 59 wherein the acid is a monocarboxylic acid.

61. A method according to claim 60 wherein the acid includes an organic radical having from 1 to about 3 carbon atoms.

62. A method according to claim 61 wherein R is an organic radical comprising from about 12 to about 20 carbon atoms.

63. A method according to claim 62 wherein $R_1$ is an organic radical comprising from 1 to about 3 carbon atoms.

64. A method according to claim 63 wherein $R_2$ is an organic radical comprising from 1 to about 3 carbon atoms.

65. A method according to claim 64 wherein the lubricating composition comprises at least approximately 2% alkyl betaine by weight.

66. A method according to claim 65 wherein the lubricating composition comprises approximately 10–17% alkyl betaine by weight.

67. A method according to claim 51 wherein the lubricating composition further comprises a nonchelating corrosion inhibitor.

68. A method according to claim 67 wherein the nonchelating corrosion inhibitor comprises a tertiary amine having the following formula:

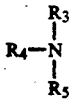

wherein $R_3$, $R_4$ and $R_5$ are organic radicals that are the same or different.

69. A method according to claim 68 wherein $R_3$ is an organic radical comprising from about 8 to about 20 carbon atoms.

70. A method according to claim 69 wherein $R_4$ is an organic radical comprising from about 8 to about 20 carbon atoms.

71. A method according to claim 70 wherein $R_5$ is an organic radical comprising from 1 to about 3 carbon atoms.

72. A method according to claim 67 wherein the nonchelating corrosion inhibitor comprises approximately 1–3% dicoco methylamine by weight.

73. A method according to claim 51 wherein the lubricating composition consists essentially of the alkyl betaine, a nonchelating acid and an aqueous solvent.

74. A composition according to claim 37 consisting essentially of the nonchelating acid, the alkyl betaine and an aqueous solvent.

75. A lubricating agent according to claim 1 consisting essentially of the alkyl betaine, the nonchelating acid and the aqueous solvent.

* * * * *